US008727297B2

(12) United States Patent
Kelley, III

(10) Patent No.: US 8,727,297 B2
(45) Date of Patent: May 20, 2014

(54) MUSIC STAND

(76) Inventor: Ted N. Kelley, III, Boca Raton, FL (US)

( * ) Notice: Subject to any disclaimer, the term of this patent is extended or adjusted under 35 U.S.C. 154(b) by 0 days.

(21) Appl. No.: 13/469,197

(22) Filed: May 11, 2012

(65) Prior Publication Data

US 2012/0223035 A1 Sep. 6, 2012

Related U.S. Application Data

(63) Continuation-in-part of application No. 12/825,382, filed on Jun. 29, 2010, now abandoned.

(60) Provisional application No. 61/292,635, filed on Jan. 6, 2010.

(51) Int. Cl.
*A47B 97/04* (2006.01)

(52) U.S. Cl.
USPC ..... 248/447; 108/32; 108/38

(58) Field of Classification Search
CPC .... A47B 97/04; A47B 19/00; A47B 21/0314; A47B 17/036; A47B 19/06; B25H 1/04
USPC ..... 248/441.1, 447; 108/1, 6, 17, 28, 32, 38
See application file for complete search history.

(56) References Cited

U.S. PATENT DOCUMENTS

| | | | | |
|---|---|---|---|---|
| 304,806 | A | | 9/1884 | Downs |
| 756,040 | A | | 3/1904 | Moulton |
| 1,091,290 | A | | 3/1914 | Carr |
| 2,829,939 | A | | 4/1958 | Boris Hoppe |
| 3,271,044 | A | | 9/1966 | Bosko |
| 3,669,227 | A | | 6/1972 | Alford |
| 4,166,926 | A | | 9/1979 | Sieler |
| 4,588,074 | A | | 5/1986 | Strong et al. |
| 4,848,710 | A | | 7/1989 | Newman |
| 4,892,334 | A | | 1/1990 | Sinclair |
| D306,534 | S | | 3/1990 | Bacon et al. |
| 4,913,502 | A | | 4/1990 | Russell |
| 5,028,048 | A | | 7/1991 | Watson et al. |
| 5,067,535 | A | * | 11/1991 | Wolff ..... 144/286.1 |
| 5,080,315 | A | | 1/1992 | Tucker-Schafer |
| 5,390,608 | A | | 2/1995 | McLaren et al. |
| D365,461 | S | | 12/1995 | Falter |
| 5,855,351 | A | * | 1/1999 | Cziraky et al. ..... 248/451 |
| 5,941,713 | A | | 8/1999 | Wayner et al. |
| 6,047,750 | A | * | 4/2000 | Jensen ..... 144/286.1 |
| D472,728 | S | | 4/2003 | Harris et al. |
| 6,736,469 | B2 | | 5/2004 | Long |
| 6,955,130 | B2 | | 10/2005 | Phillips |

(Continued)

*Primary Examiner* — Bradley Duckworth
(74) *Attorney, Agent, or Firm* — Buckingham Doolittle & Burroughs, LLC

(57) ABSTRACT

An organizational music stand architecture for practicing or performing, while at the same time organizing and storing various accessories for music. The stand comprises a base section, two side sections, and a back section secured together. An accessory plate assembly, situated at the top of the unit, is secured to the two side sections. A music rest platform is secured to the accessory plate assembly so as to display objects in a near vertical position. The height of the base section is designed for placement of the organizational stand on a floor surface. Typically, the organizational stand would also comprise wheels, positioned at the bottom of the base section toward the rear of the stand, enabling the stand to be rolled on the wheels to another location. There would also be at least one or two drawers, such as a utility drawer and a hanging-file drawer.

11 Claims, 9 Drawing Sheets

(56) References Cited

U.S. PATENT DOCUMENTS

| | | | | |
|---|---|---|---|---|
| 7,106,014 | B1 | 9/2006 | Mastalir | |
| 7,278,621 | B1 | 10/2007 | Bareis | |
| 7,523,900 | B1 | 4/2009 | Hlatky | |
| 2003/0079661 | A1 | 5/2003 | Luu | |
| 2006/0027146 | A1 | 2/2006 | Lee | |
| 2006/0080972 | A1 | 4/2006 | Krieger et al. | |
| 2006/0103089 | A1* | 5/2006 | Decoste | 280/47.34 |
| 2009/0078165 | A1 | 3/2009 | Tseng | |
| 2009/0266274 | A1 | 10/2009 | Berlin et al. | |
| 2011/0056412 | A1 | 3/2011 | Grammer et al. | |

* cited by examiner

MUSIC STAND

CROSS-REFERENCE

This application is a continuation-in-part and claims priority from Non-Provisional patent application Ser. No. 12/825,382 filed Jun. 29, 2010 which claims priority from Provisional Patent Application No. 61/292,635 filed Jan. 6, 2010.

BACKGROUND

Portability and convenience along with storage have long been the desires of artists, musicians, and other users regarding stands and organizational cabinets and easels. Typical music stands currently being manufactured are designed for use in groups in an orchestra, band or on stage, either during performances or in practice. As such, most of these music stands have a single leg, are lightweight, collapsible and as unobtrusive as possible. Stands of this type, however, typically lack rigidity. As a result, they are typically unstable and often do not provide adequate support for sheets or books of music, especially when the music is thin, or is bulky in size. They are also not suitable for supporting heavy items such as music books. And, typical music stands also do not allow for the storage of music books, instrument and music accessories or sheet music. The primary function of this invention is to improve the standard music stand by adding weight and stability to a music stand, and also, combining that music stand function with a storage cabinet function so that a single location can serve as a practice area and also as a storage area for ease of access of everything a musician needs while playing, and providing a location to store everything when done.

Therefore, a combination music stand with a hinged, and severely angled music rest for upright display that allows functionality of a clear upright view for easy reading music at eye level would be useful. It would also be useful for a combination music stand that can also be used for organizing the musician by storing various accessories for music, arts, etc. This type of stand would be sturdier, larger and more stable than typical stands and organizational cabinets. It would have full sides from the top of the music rest to the floor, creating a free standing cabinet with wheels, interior shelves, a utility drawer and a drawer for hanging file folders of music sheets and books. This free standing floor cabinet would have the effect of keeping everything organized and readily accessible, would reduce clutter in the practice area, and would provide a location to keep a variety of accessories and music in one place, that place being the same location where the musician practices his or her music.

The cabinet organizer, a home base for the practice area of the musician, artist or craftsman, remains portable similar to a typical music stand or easel because of its rear wheels, allowing the stand to be positioned on the floor and then easily transported to another location, via tilting the stand and rolling the stand on its wheels. In this way the musician can play his music, find everything he needs while doing so, finish playing, and put everything away in a logical, easy manner, then wheel the stand out of the way. Additionally, the disclosed invention cannot be used as a desk since the music rest is not hinged beyond opening up to access the interior.

Furthermore, the music rest angle needs to be severe, with a strong, wide, bottom rail to hold music books upright for a clear view at eye level for the seated musician, and at an upright angle necessary for the sight line to have no perspective distortion, said angle being typical of standard metal music stands known in the art. The design would create enough room to store accessories, supplies, and instrument maintenance items, and/or books, music items and other equipment, while allowing steady, secure portable placement of the unit on floor surfaces.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an organizational stand for organizing and storing various accessories for music, arts, crafts, or other accessories. The stand comprises a base section, two side sections, and a back section secured together. An accessory plate assembly, situated at the top of the unit, is secured to the two side sections. A front-facing angled music rest platform is secured to the accessory plate assembly so as to display sheet music, books, or other flat objects. The height of the base section is designed for placement of the organizational stand on a floor surface and viewing of the subject matter from a seated position typical of a performing musician. Typically, the organizational stand would also comprise wheels. The wheels would be positioned at the bottom of the base section toward the rear of the stand. The stand could then be tilted so as to permit the wheels to contact the ground and enabling the stand to be rolled on the wheels to another location.

Furthermore, the accessory plate assembly comprises at least one recessed tray for storage of accessories, such as instrument accessories, musical tools, cellular phones, timers, water bottles, cups or cans. Additionally, at least one shelf can be located within the interior of the stand for retaining sheet music, books or other accessories and tools. Additionally, the music rest platform extends from two hinges connected along a front side of the accessory plate assembly and pivots upward to a full vertical position for access to the interior, but which cannot be opened any further and cannot be used for any other uses, (i.e., desk). The sole purpose of the music rest platform is to hold music in its closed, natural position or to be opened to allow interior access of the organizational stand. When closed, the music rest platform preferably extends down to several inches above the second shelf of the stand, leaving an opening underneath to allow partial access to the interior of the stand. Below that opening, at least one drawer is provided, typically the organizational stand would comprise two drawers, one drawer designated as a narrow utility drawer and the other drawer being deeper and designated as a hanging file drawer for the hanging storage of sheet music or music books.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
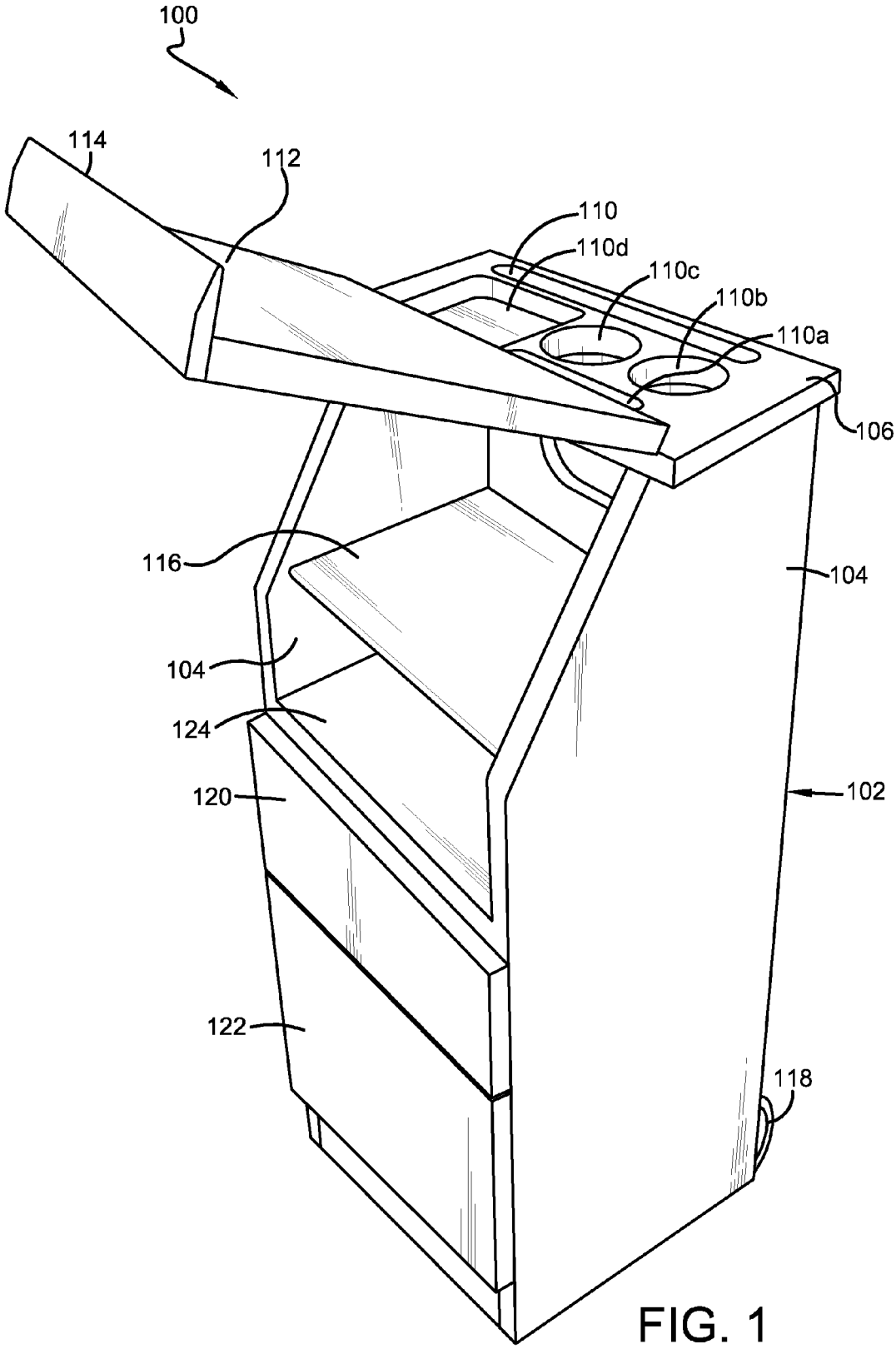
FIG. 1 illustrates a perspective view of the front and right side of the stand wherein the music rest platform is partially opened.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

Typically, music stands, art easels, and other such stands and cabinets are light weight and collapsible. As a result, these stands and easels often do not provide adequate support for sheets or books of music, art projects, etc. These stands and easels also do not allow for the storage of accessories. Therefore, an organizational stand for use primarily for organizing and storing accessories would be useful.

Accordingly, the inventive device is an organizational stand for organizing and storing various accessories for music, arts, or other accessories. The front plate or music rest platform of the stand device is designed to hold music sheets, books, and other flat objects, while the accessory plate assembly, located on the top of the stand and always accessible, as well as the interior, are designed for the organization, ease of access and storage of instrument and music accessories, tools, musical scores, books, oils, cloths, various mouthpieces, pens, pencils, picks, tuners, reed refinishing blocks, metronomes, tape recorders, cellular phones, timers, etc. Furthermore, the cabinet (or stand) is a floor unit designed to be supported on a floor surface. The stand would also comprise wheels, allowing the stand to be positioned on the floor and then easily transported to another location, via tilting the stand and rolling the stand on its wheels.

Referring initially to the drawings, FIG. 1 illustrates an organizational stand 100 for organizing and storing various accessories for music, arts, crafts, or other accessories. The organizational stand 100 comprises a base section 102 secured to two side sections 104, and a back section 408. The two side sections 104 and back section 408 are typically secured to the base section 102 via fasteners, gluing, dove-tail joining, etc. or any other suitable securing method as is known in the art without affecting the overall concept of the invention. However, the two side sections 104 are not needed and can be replaced by a plurality of supports (not shown). Specifically, the base section 102 would comprise four supports or columns, or other suitable shaped structures that would be positioned at the corners of the base section 102 to support the base section 102 and provide structure to the stand 100. However, any suitable number of supports can be used without affecting the overall concept of the invention.

Typically, the organizational stand 100 is rectangular shaped, however any other suitable shape can be used as is known in the art without affecting the overall concept of the invention. The organizational stand 100 would generally be constructed of plywood, particle board, oriented strand board (OSB), metal, etc., though any other suitable material may be used to manufacture the organizational stand 100 as is known in the art without affecting the overall concept of the invention. The organizational stand 100 is approximately between 35 and 50 inches in height as measured from the bottom to the top of the base section 102, approximately between 10 and 20 inches wide as measured from opposing side sections 104, and approximately between 10 and 20 inches in depth as measured from front music rest platform 112 to back section 408.

The height of the base section 102 is designed for placement of the organizational stand 100 on a floor surface. Typically, the organizational stand 100 would comprise wheels 118 to enable a user to more easily reposition stand 100 along a floor, although the organizational stand 100 does not require wheels 118 and can be used without the same. The wheels 118 would be positioned at the bottom of the base section 102 toward the rear of the stand 100. Generally, two wheels 118 would be used, such that the stand 100 would be tilted at approximately a 45 degree angle to the ground, allowing the wheels 118 to contact the ground and enabling the stand 100 to be rolled on the wheels 118 to another location (i.e., the stand would be wheeled similar to a dolly), and the drawers (see below) would prevent the content of the stand from falling out when the stand is tilted. However, any suitable number of wheels 118 can be used as is known in the art without affecting the overall concept of the invention. For example, the stand 100 could comprise four wheels 118, positioned underneath the bottom of the base section 102 such that the stand 100 would rest on and be supported by the four wheels 118. The four wheels 118 would swivel, allowing the stand 100 to be moved from place to place. Thus, the organizational stand 100, with the long base section 102 and wheels, allows the stand 100 to be positioned on the floor and then easily transported to another location (e.g., moved from a user's home to a studio or other location), via either tilting the stand 100 and rolling the stand on its wheels 118, similar to using a dolly, or by utilizing four wheels and pushing the stand 100 across the floor via the wheels 118.

The base section 102 of the organizational stand 100 can also comprise at least one pull-out drawer 120. Preferably, the base section 102 comprises a second pull-out drawer 122 as well, though any suitable number of drawers can be used as is known in the art. The drawers 120 and 122 have the appearance of a typically constructed drawer as is known in the art, and can comprise rods or ridges in the sides for hanging files, or any other suitable accessory as is known in the art. The drawers 120 and 122 are designed for storing music and music accessories and paperwork, instructional books, etc., or any other accessory as is known in the art.

Further, an accessory plate assembly 106 is then secured to the two side sections 104. The accessory plate assembly 106 is preferably angled from the rear to the front to create a generally trapezoidal shape, though any other suitable shape can be used as well, as is known in the art. The accessory plate assembly 106 comprises at least one recessed tray 110. Typically, there are multiple recessed trays 110 *a, b, c, d*, positioned on the accessory plate assembly 106 as depicted in FIG. 1, however any suitable number of recessed trays 110 *a, b, c, d*, can be formed in the accessory plate assembly 106 as is known in the art. For example, the recessed trays can comprise a large oblong slot 110, a small oblong slot 110*a*, a recessed cylinder 110*b* and 110*c*, or a rectangular tray 110*d*.

As shown in the embodiment of FIG. 1, the accessory plate assembly 106 comprises a large oblong slot 110 or a small oblong slot recessed tray 110*a* which can be used for the placement of accessories such as a metronome, tape recorder or cellular telephone. The oblong slot would hold thin objects with a front display, which when placed in the oblong slot 110 or 110*a* on their edge would show a clear upright hands free display. The accessory plate assembly 106 of FIG. 1 also comprises two recessed cylinders 110*b* and 110*c*. The recessed cylinders are approximately 2 inches deep, but could be between 1 and 5 inches deep. The two cylinders are recessed approximately 3 inches in diameter, but could be between 2 and 5 inches in diameter. The cylinder 110*b* is primarily used as a universal mouthpiece holder, small object holder, cupholder for cups, cans or water bottles, etc. Further, the accessory plate assembly 106 of FIG. 1 also comprises a rectangular catch-all tray 110*d* for accessories such as reeds, eyeglasses, pencils, pens, guitar picks, paints, brushes, glue, or other accessories. All the recessed trays 110 *a, b, c, d*, can be used for multiple purposes at the user's discretion.

Furthermore, the organizational stand 100 also comprises a music rest platform 112. The music rest platform 112 is secured to the front side of the accessory plate assembly 106. The music rest platform 112 is typically secured via hinges, but could also be secured by any other suitable fastener as is known in the art. The music rest platform 112 pivots upwards to a vertical position, fully exposing the interior of the stand 100 and an interior shelf 116. The music rest platform 112 cannot be opened past the vertical position and has no other hinged purpose than to open to allow access to the interior shelves. When closed, the music rest platform 112 preferably extends down at approximately between 25 and 80 degrees, resting on the top edge of the two side sections 104 of the stand 100, but other angular arrangements as is known in the art could be used without affecting the overall concept of the invention. The music rest platform 112 extends down approximately 3 inches above the base section 102 of the stand 100, but could be between 1 and 6 inches. The music rest platform 112 leaves an opening exposed underneath, thus allowing a user to partially access the interior of the stand 100.

Further, a support rail 114 is positioned along the bottom of the music rest platform 112, extending out approximately 1 and ½ inches at an 80 degree angle to the music rest platform 112, extending horizontally along its full length, but could be between 1 and 4 inches, and the angle could vary between 60 and 90 degrees. The support rail 114 allows for holding sheet music, books, or any other flat object. The interior of the organizational stand 100 is an open box and storage cabinet, with at least one shelf 116, typically the stand 100 comprises a second shelf 124. The shelves 116 and 124 have the appearance of a typically constructed shelf as is known in the art, and are designed for storing music, arts, and craft accessories and paperwork, instructional books, etc., or any other accessory as is known in the art. The shelves 116 and 124 are approximately 7 inches wide and 14 inches long, but could be between 6 and 9 inches wide and between 13 and 15 inches wide.

Figure 2:
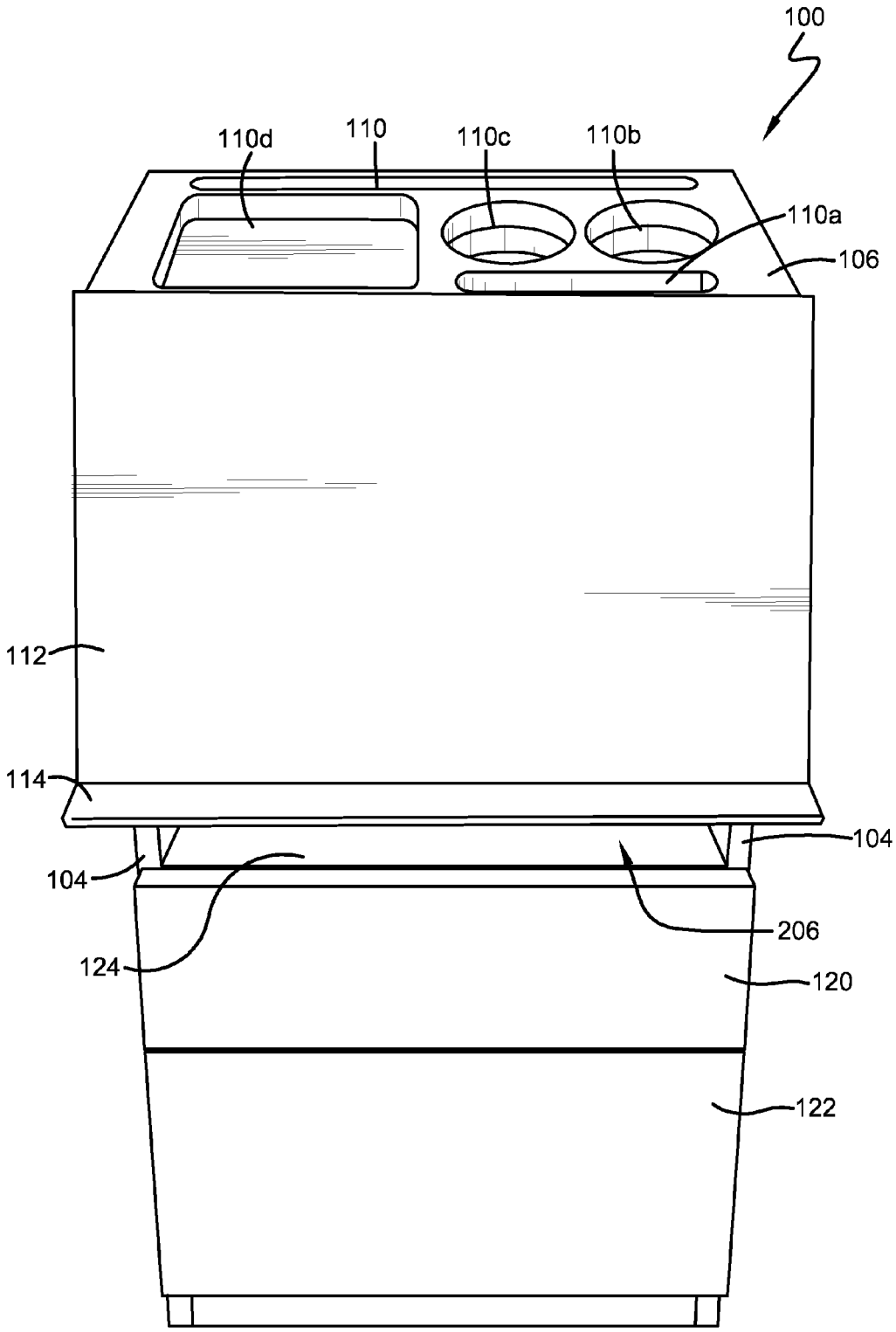
FIG. 2 illustrates a perspective view of the front of the stand wherein the music rest platform is closed.

FIG. 2 illustrates an organizational stand 100, wherein the music rest platform 112 is in a closed position. The music rest platform 112 is secured to a front side of the accessory plate assembly 106, resting on the top edge of the two side sections 104 of the stand 100. The music rest platform 112 is typically secured via hinges, but could also be secured by any other suitable fastener as is known in the art without affecting the overall concept of the invention. The music rest platform 112 pivots upwards to a vertical position, fully exposing the interior of the stand 100 and an interior shelf 116. The music rest platform 112 cannot be opened past the vertical position and has no other hinged purpose than to open to allow access to the interior shelves. When closed, the music rest platform 112 extends down at approximately a 35 degree angle, but could be between 25 and 80 degrees, resting on the stand 100. The music rest platform 112 extends down approximately 4 inches above the bottom of the second shelf 126, but could be between 1 and 6 inches. The music rest platform 112 leaves an opening 206 exposed underneath, thus allowing a user to partially access the interior of the stand 100.

Further, a support rail 114 is positioned along the bottom of the music rest platform 112, extending out approximately 1 and ½ inches at an 80 degree angle horizontally along its full length, but could be between 1 and 4 inches and between 60 and 90 degrees. The support rail 114 allows for holding sheet music, books, or any other flat object.

The accessory plate assembly 106 also comprises at least one recessed tray (110, 110*a*, 110*b*, 110*c*, 110*d*). Typically, there are multiple recessed trays positioned on the accessory plate assembly 106, however any suitable number of recessed trays can be formed in the accessory plate assembly 106 as is known in the art. Further, the recessed trays can comprise a large oblong slot 110, a small oblong slot 110*a*, a recessed cylinder 110*b* and 110*c*, or a rectangular tray 110*d*.

The large oblong slot 110 or small oblong slot 110*a* would hold thin objects that have a front display, which when placed in the large oblong slot 110 or small oblong slot 110*a* on their edge would show a clear upright hands free display, such as a metronome, tape recorder or cellular telephone. The recessed cylinders (2) 110*c* are primarily used for holding cans, cups or water bottles, but could also be used as a universal mouthpiece holder, or other small object holder. Further, the rectangular catch-all tray 110*d* would be used for accessories such as reeds, eyeglasses, pencils, pens, guitar picks, paints, brushes, glue, or other accessories. However, all the recessed trays (110, 110*a*, 110*b*, 110*c*, and 110*d*) can be used for multiple purposes at the user's discretion.

Figure 3:
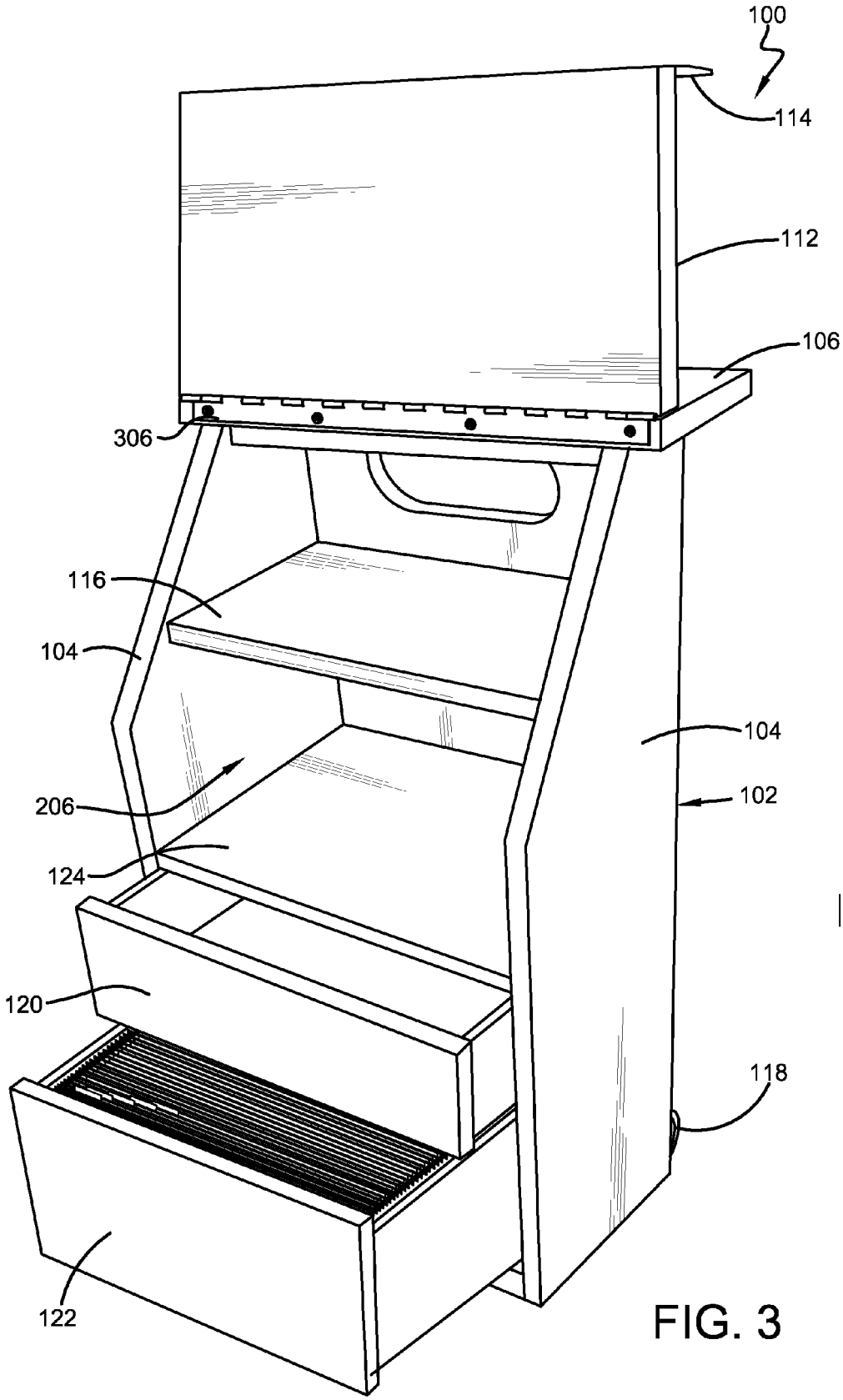
FIG. 3 illustrates a perspective view of the front and right side of the stand wherein the music rest platform is fully opened and the drawers are partially opened.

Furthermore, FIG. 3 illustrates an organizational stand 100, wherein the music rest platform 112 and the drawers 120 and 122 are in an open position. The music rest platform 112 is secured to a front side of an accessory plate assembly 106. The music rest platform 112 is typically secured via hinges 306, but could also be secured by any other suitable fastener as is known in the art. The music rest platform 112 pivots upwards to a vertical position, fully exposing the interior of the stand 100 and an interior shelf 116. The music rest platform 112 cannot be opened past the vertical position and has no other hinged purpose than to open to allow access to the interior shelves. When closed, the music rest platform 112 extends down at approximately a 35 degree angle, but could be between 25 and 80 degrees, resting on the two side sections 104 of the stand 100. The music rest platform 112 extends down approximately 4 inches above the second shelf 124 of the stand 100, but could be between 1 and 6 inches. The music rest platform 112 leaves an opening exposed underneath, thus allowing a user to partially access the interior of the stand 100.

The top, interior of the stand 100 is an open box with at least one shelf 116, typically, the stand 100 comprises a second shelf 124. The shelves 116 and 124 are approximately 7 inches wide and 13 inches long, but could be between 11 and 14 inches long and between 6 and 9 inches wide. Furthermore, the base section 102 of the organizational stand 100 can also comprise at least one pull-out drawer 120. Preferably, the base section 102 comprises a second pull-out drawer 122 as well, though any suitable number of drawers can be used as is known in the art. The drawers 120 and 122 have the appearance of a typically constructed drawer as is known in the art, and can comprise rods or ridges in the sides for hanging files, or any other suitable accessory as is known in the art. The drawers 120 and 122 are designed for storing music and music accessories and paperwork, instructional books, etc., or any other accessory as is known in the art. Typically, utility drawer 120 slides open with a handle and would be used for the storage of small items that fit into that size of a drawer. Beneath the utility drawer 120 is a hanging file drawer 122, for the organized storage of paper music scores or music books, or other objects.

Figure 4:
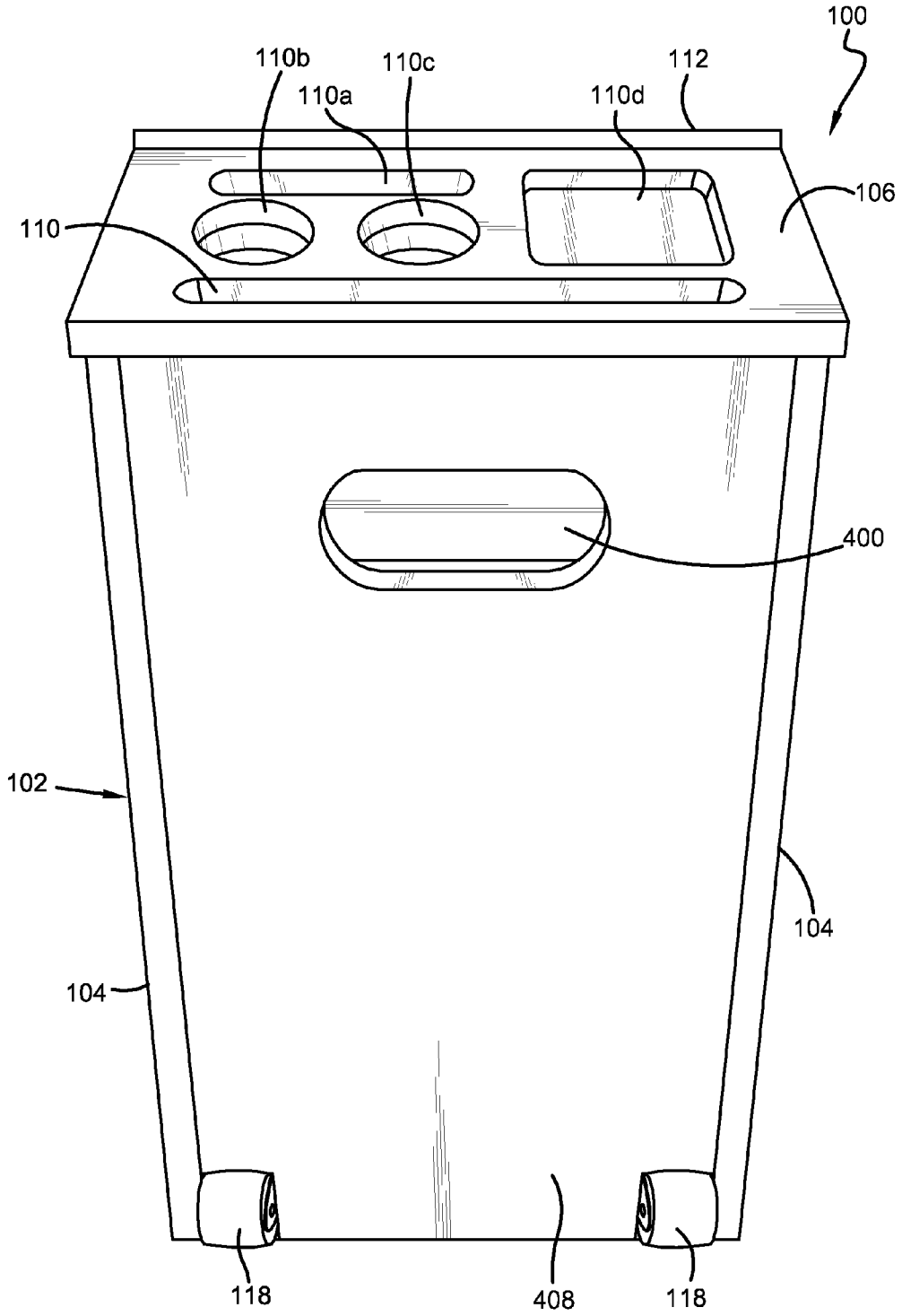
FIG. 4 illustrates a perspective view of the rear of the stand.

Furthermore, FIG. 4 illustrates the back of the organizational stand 100. The stand 100 comprises two side sections 104 secured to a back section 408 with wheels at the bottom for portability by tilting and moving the cabinet. An accessory plate assembly 106 is secured to the two side sections 104. The accessory plate assembly 106 comprises at least one recessed tray 110 *a, b, c, d*. Typically, there are multiple recessed trays 110 *a, b, c, d*, positioned on the accessory plate assembly 106, however any suitable number of recessed trays 110 *a, b, c, d*, can be formed in the accessory plate assembly 106. Further, the recessed trays can comprise a large oblong slot 110, a small oblong slot 110*a*, a recessed cylinder 110*b* and 110*c*, or a rectangular tray 110*d*. All the recessed trays 110 *a, b, c, d*, can be used for multiple purposes at the user's discretion.

Further, an opening 400 in the top of the back section 408 provides an access hole to serve as a handle when tilting and moving the cabinet, and/or as a feed-thru for wires, electrical plugs, etc. The opening 400 is approximately 6 to 12 inches wide.

Figure 5:
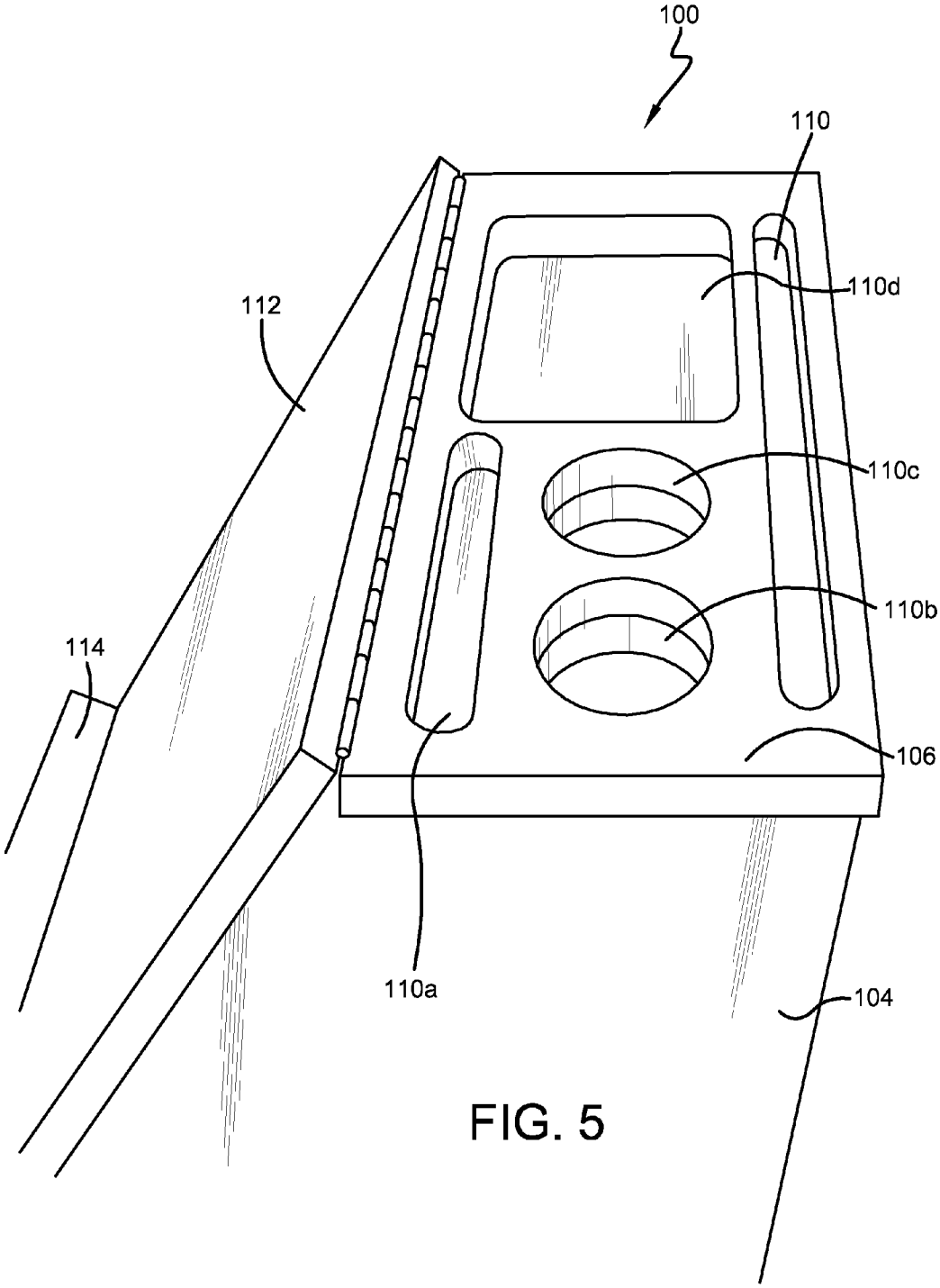
FIG. 5 illustrates a perspective view of the top of the stand.

FIG. 5 illustrates the top of the organizational stand 100, comprising an accessory plate assembly 106. The accessory plate assembly 106 comprises at least one recessed tray (110, 110*a*, 110*b*, 110*c*, 110*d*). Typically, there are multiple recessed trays positioned on the accessory plate assembly 106, however any suitable number of recessed trays can be formed in the accessory plate assembly 106 as is known in the art. Further, the recessed trays can comprise a large oblong slot 110, a small oblong slot 110*a*, a recessed cylinder 110*b* and 110*c*, or a rectangular tray 110*d*.

The large oblong slot 110 or small oblong slot 110*a* would hold thin objects with a front display, which when placed in the large oblong slot 110 or small oblong slot 110*a* on their edge would show a clear upright hands free display, such as a metronome tape recorder or cellular telephone. The recessed cylinders 110*b* are primarily used as a universal mouthpiece holder, or other small object holder and for holding cans, cups or water bottles. Further, the rectangular catchall tray 110*d* would be used for accessories such as reeds, eyeglasses, pencils, pens, guitar picks, paints, brushes, glue, or other accessories. However, all the recessed trays (110, 110*a*, 110*b*, 110*c*, 110*d*) can be used for multiple purposes at the user's discretion.

Furthermore, the organizational stand 100 also comprises a music rest platform 112 secured to the front side of the accessory plate assembly 106. When closed, the music rest platform 112 rests on the top edge of the two side sections 104 of the stand 100. Additionally, a support rail 114 is positioned along the bottom of the music rest platform 112 for holding sheet music, books, or any other flat object.

Figure 6:
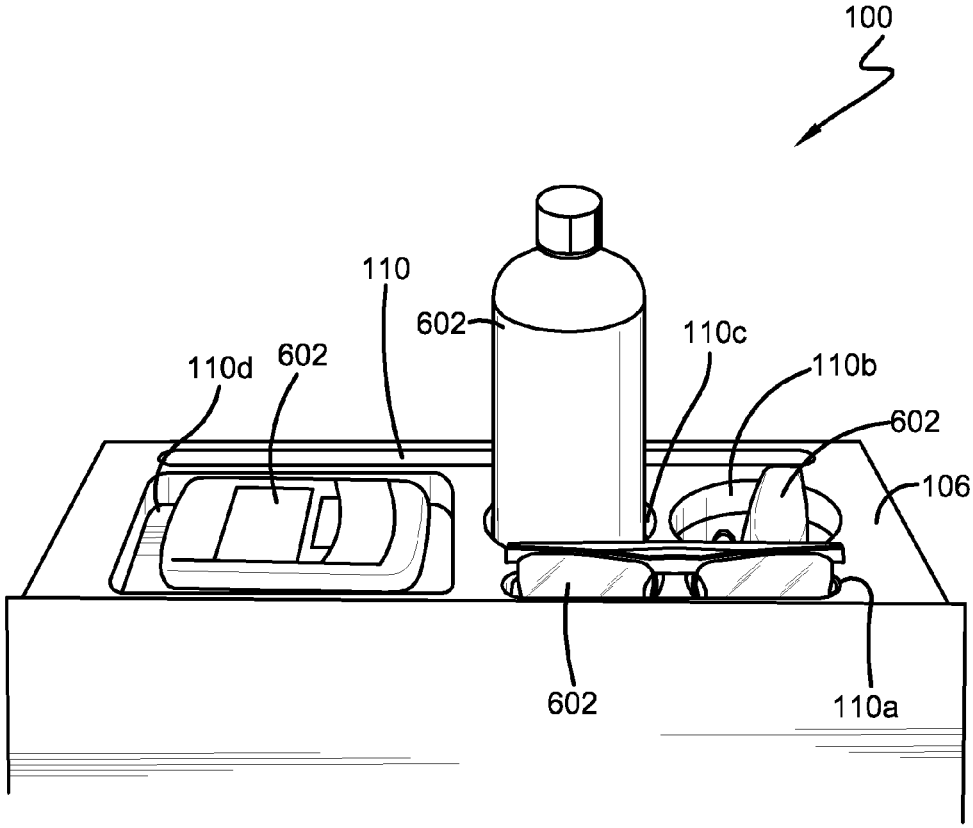
FIG. 6 illustrates a perspective view of the top of the stand wherein accessories are stored in the recessed trays.
Figure 7:
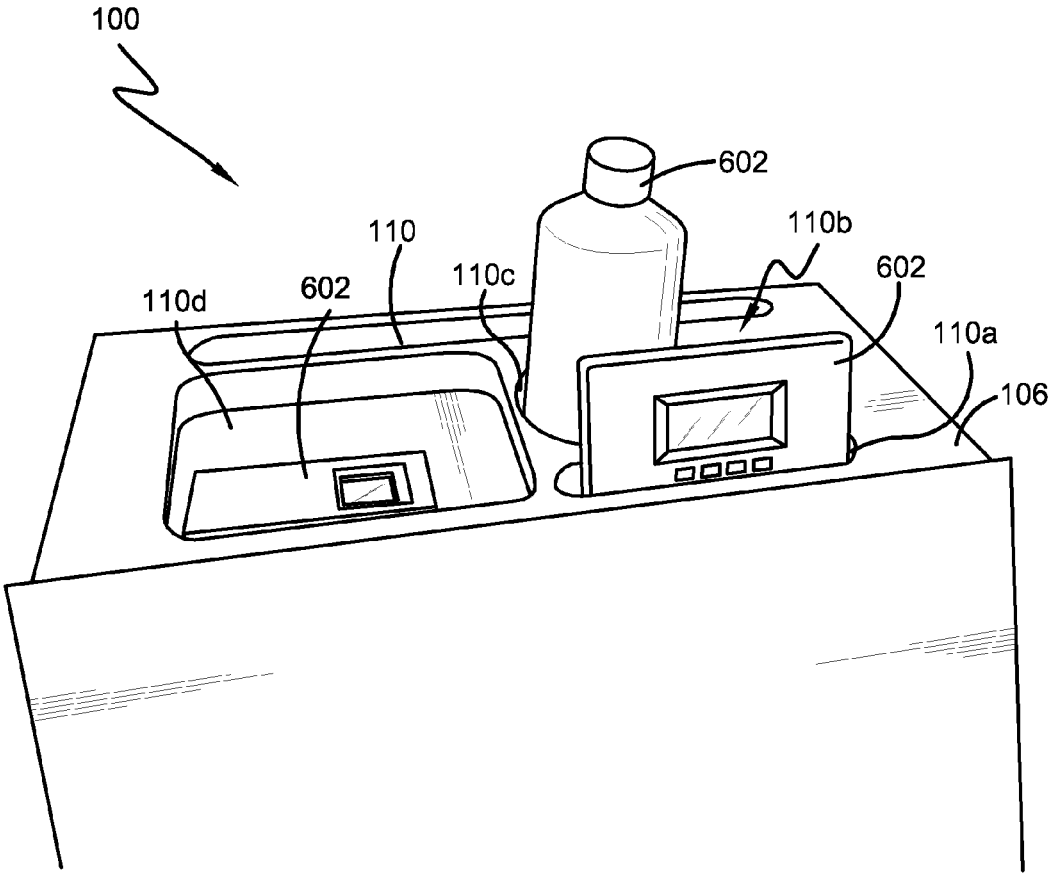
FIG. 7 illustrates a perspective view of the top of the stand wherein additional accessories are stored in the recessed trays.
Figure 8:
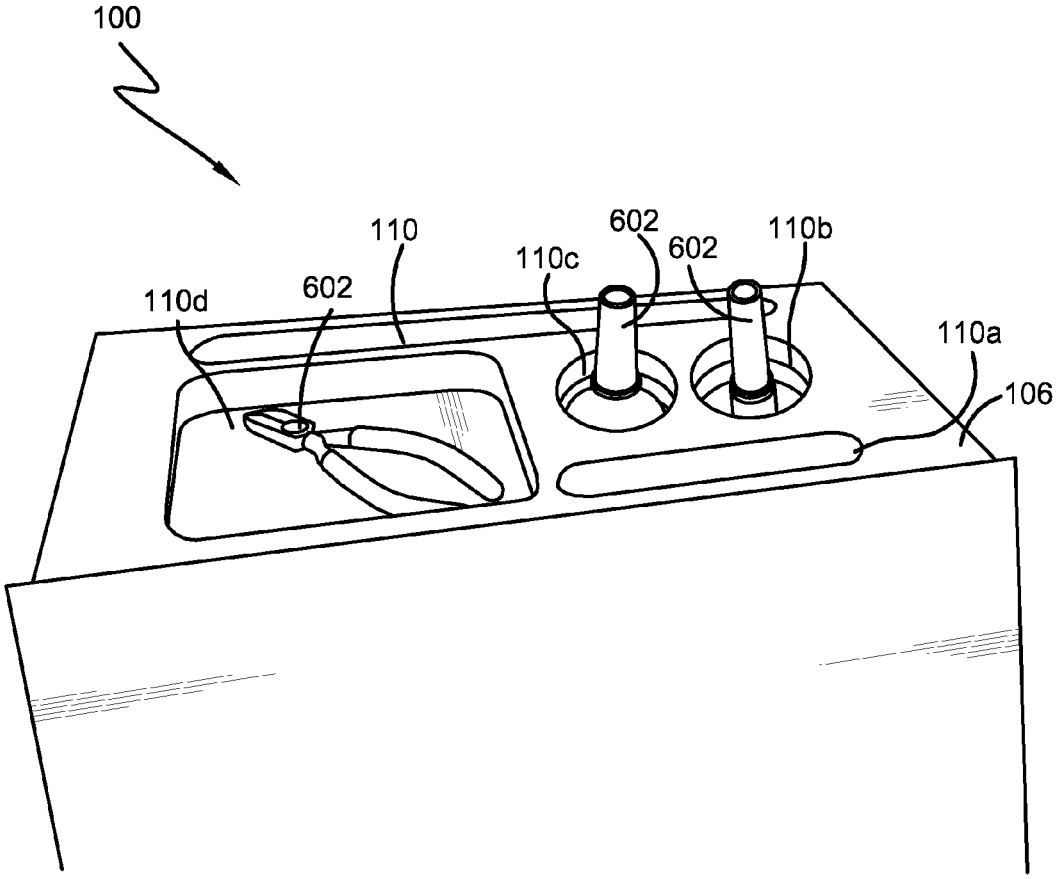
FIG. 8 illustrates a perspective view of the top of the stand wherein additional accessories are stored in the recessed trays.

FIGS. 6-8 illustrate an organizational stand 100 wherein various accessories 602 are stored in the recessed trays 110 *a, b, c, d*, of the accessory plate assembly 106.

Figure 9:
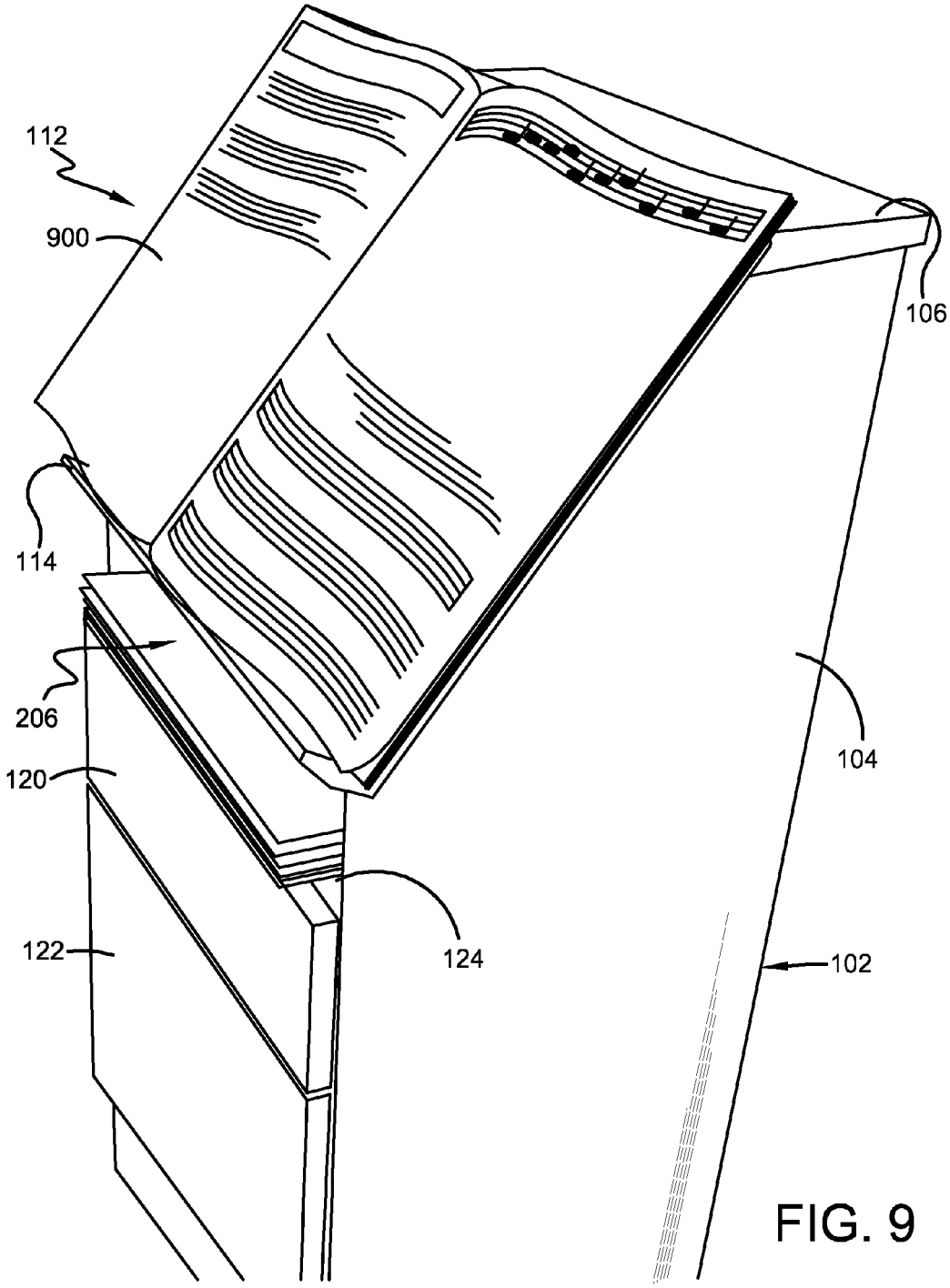
FIG. 9 illustrates a perspective view of the stand wherein a music book is displayed on the music rest platform.

FIG. 9 illustrates an organizational stand 100 wherein the music rest platform 112 is displaying a music book 900. The music book 900 rests on the support rail 114 of the music rest platform 112. The support rail 114 is positioned along the bottom of the music rest platform 112, extending out approximately 1 and ½ inches at an 80 degree angle horizontally along its full length, but could be between 1 and 4 inches and between 60 and 90 degrees. The support rail 114 allows for holding sheet music, books, and other flat objects.

The music rest platform 112 is secured to the front side of the accessory plate assembly 106. The music rest platform 112 is typically secured via hinges, but could also be secured by any other suitable fastener as is known in the art. The music rest platform 112 pivots up when open to a full vertical position, the sole purpose of which is to allow access to the inside of the organizational stand, specifically to the interior shelf. It does not pivot back into a desk and cannot be used for any other purpose than as an upright display of music or other objects that need to be read in a near vertical position. When closed, the music rest platform 112 extends down at a 25 degree angle, resting on the top edge of the two side sections 104 of the stand 100. The music rest platform 112 extends down approximately 4 inches above the base section 102 of the stand 100, but could be between 1 and 6 inches. The music rest platform 112 leaves an opening 206 exposed underneath, thus allowing a user to partially access the interior of the stand 100 even when the music rest platform 112 is closed. Beneath the opening can be at least one drawer, typically the organizational stand comprises two drawers: a utility drawer approximately 4" tall and a hanging file drawer, approximately 12" tall.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An organizational stand, comprising:

a base section that allows for placement of the organizational stand on a floor surface;

at least one pull-out drawer secured within the base section and comprising ridges in sides of the at least pull-out drawer for hanging files;

two side sections secured to the base section;

a back section secured to the base section and two side sections;

an accessory plate assembly secured to the two side sections, the accessory plate assembly comprising a front side and a back side;

a music rest platform comprising a support rail and secured to the front side of the accessory plate assembly to display objects; wherein the music rest platform is a hinged plate that extends from two hinges connected along the front side of the accessory plate assembly, and that opens to a vertical position for interior access to the stand and extends downward at an angle between 60 and 90 degrees to the base section to display an object on the support rail; and wherein the music rest platform when extended downward, leaves an opening exposed underneath the music rest platform that allows a user partial access to the interior of the stand; and a pair of wheels secured to a bottom of the base section toward a rear of the organizational stand at such a height that the pair of wheels does not contact the floor surface and the base section is flush with the floor surface, and wherein when the base section is tilted at approximately a 45 degree angle to the floor surface the pair of wheels contacts the floor surface and enables the organizational stand to be rolled on the pair of wheels.

2. The organizational stand of claim 1, wherein the base section is generally between 35 to 50 inches in height.

3. The organizational stand of claim 2, further comprising at least one shelf located within interior of the base section.

4. The organizational stand of claim 1, wherein the accessory plate assembly comprises at least one recessed tray for placement of accessories.

5. The organizational stand of claim 4, wherein the accessories comprise at least one of music supplies, tools, oils, cloths, tuners, metronomes, tape recorders, cellular telephones, instrument mouthpieces, reeds, eyeglasses, pencils, pens, guitar picks, water bottles, cups or cans.

6. An organizational stand for providing storage and a work or practice area, comprising:

a base section, two side sections, and a back section secured together;

at least one pull-out drawer secured within the base section and comprising ridges in sides of the at least pull-out drawer for hanging files;

an accessory plate assembly secured to the two side sections and comprising at least one tray and at least one recessed cylinder for retaining accessories; and a music rest platform comprising a support rail, the music rest platform extends from two hinges connected along a front side of the accessory plate assembly and pivots upward to a vertical position to allow interior access to the organizational stand when fully opened and extends downward at an angle between 60 and 90 degrees to the base section to display an object on the support rail; and wherein the music rest platform when extended downward, leaves an opening exposed underneath the music rest platform that allows a user partial access to the interior of the organizational stand; and wherein the base section allows for placement of the organizational stand on a floor surface; and a pair of wheels secured to a bottom of the base section toward a rear of the organizational stand at such a height that the pair of wheels does not contact the floor surface and the base section is flush with the floor surface, and wherein when the base section is tilted at approximately a 45 degree angle to the floor surface the pair of wheels contacts the floor surface and enables the organizational stand to be rolled on the pair of wheels.

7. The organizational stand of claim 6, further comprising at least one shelf located within interior of the base section.

8. The organizational stand of claim 6, wherein the accessory plate assembly creates a rectangular shape.

9. A transportable, organizational stand, comprising:

a base section and a back section secured together, wherein the base section comprises at least one set of supports and allows for placement of the organizational stand on a floor surface;

at least one pull-out drawer secured within the base section and comprising ridges in sides of the at least pull-out drawer for hanging files;

an accessory plate assembly secured to the base section and comprising at least one recessed cylinder for retaining accessories; and a music rest platform comprising a support rail, the music rest platform extends from two hinges connected along a front side of the accessory plate assembly and pivots upward to a vertical position when fully opened, and when closed the music rest platform extends down 60and 90 degrees to the base section to display an object on the support rail; and wherein the music rest platform when extended downward, leaves an opening exposed underneath the music rest platform that allows a user partial access to the interior of the organizational stand; and a pair of wheels secured to a bottom of the base section toward a rear of the organizational stand at such a height that the pair of wheels does not contact the floor surface and the base section is flush with the floor surface, and wherein when the base section is tilted at approximately a 45 degree angle to the floor surface the pair of wheels contacts the floor surface and enables the organizational stand to be rolled on the pair of wheels.

10. The organizational stand of claim 9, wherein the base section is generally between 35 to 50 inches in height.

11. The organizational stand of claim 9, further comprising at least one shelf located within interior of the base section.

* * * * *